US007204378B2

(12) United States Patent
Schaeff

(10) Patent No.: US 7,204,378 B2
(45) Date of Patent: Apr. 17, 2007

(54) GOODS TRANSSHIPMENT APPARATUS

(75) Inventor: Hans Schaeff, Langenburg (DE)

(73) Assignee: Fuchs-Bagger GmbH & Co. KG, Bad Schonborn (DE)

( * ) Notice: Subject to any disclaimer, the term of this patent is extended or adjusted under 35 U.S.C. 154(b) by 0 days.

(21) Appl. No.: 10/387,131

(22) Filed: Mar. 13, 2003

(65) Prior Publication Data

US 2004/0033124 A1 Feb. 19, 2004

(51) Int. Cl.
*B66C 23/78* (2006.01)

(52) U.S. Cl. ..... 212/291; 202/301; 280/6.153

(58) Field of Classification Search ..... 212/291, 212/301; 280/6.153, 6.154
See application file for complete search history.

(56) References Cited

U.S. PATENT DOCUMENTS

| | | | | | |
|---|---|---|---|---|---|
| 3,430,790 | A | * | 3/1969 | Beltrami | 414/695 |
| 3,487,964 | A | * | 1/1970 | Riley | 414/550 |
| 3,742,991 | A | * | 7/1973 | McColl | 144/4.1 |
| 3,820,616 | A | * | 6/1974 | Juergens | 180/9.48 |
| 3,900,077 | A | * | 8/1975 | Gee et al. | 180/9.46 |
| 3,924,704 | A | * | 12/1975 | Lindblom et al. | 180/41 |
| 3,939,988 | A | * | 2/1976 | Wellman | 212/297 |
| 4,242,816 | A | * | 1/1981 | Jeanson | 37/331 |
| 4,365,927 | A | | 12/1982 | Schenck | |
| 4,679,803 | A | * | 7/1987 | Biller et al. | 180/9.23 |
| 5,092,659 | A | * | 3/1992 | Grathoff | 299/39.2 |
| 5,199,193 | A | * | 4/1993 | Akiba et al. | 37/341 |
| 5,984,618 | A | * | 11/1999 | Deneve et al. | 414/722 |
| 6,135,225 | A | * | 10/2000 | Barsic | 180/89.14 |
| 6,173,973 | B1 | * | 1/2001 | Robinson | 280/6.154 |
| 6,341,705 | B1 | * | 1/2002 | Kaspar | 212/302 |
| 6,343,799 | B1 | * | 2/2002 | Moyer | 280/6.154 |

FOREIGN PATENT DOCUMENTS

| | | | |
|---|---|---|---|
| DE | 29 41 813 | | 5/1981 |
| DE | 42 13 077 | | 8/1993 |
| DE | 43 31 832 | | 1/1995 |
| DE | 199 09 356 | | 9/2000 |
| EP | 0 978 472 | | 2/2000 |
| GB | 1 048 722 | | 11/1966 |
| GB | 1 374 253 | | 11/1974 |
| JP | 03-721123 | * | 3/1991 |
| JP | 11-200417 | * | 7/1999 |

* cited by examiner

*Primary Examiner*—Thomas J Brahan
(74) *Attorney, Agent, or Firm*—Shlesinger, Arkwright & Garvey LLP

(57) ABSTRACT

A goods transshipment apparatus having a mobile substructure with a superstructure mounted so as to be rotatable relative to said substructure and having a driver's cab and engine compartment and a jib or jib system jointed to the superstructure wherein the superstructure is adjustable between a lower position (resting position I) on the substructure and an upper position (operating position II) at a spacing from the substructure.

19 Claims, 16 Drawing Sheets

GOODS TRANSSHIPMENT APPARATUS

FIELD OF THE INVENTION

The present invention relates to a goods transshipment apparatus.

DESCRIPTION OF THE RELATED ART

Goods transshipment apparatus of this kind, also known as loading or shipping apparatus, are used primarily in inner ports and the adjacent stockyards for transshipping i.e. loading and unloading all kinds of materials such as wood, scrap metal, gravel, sand and the like. Goods transshipment apparatus are high performance flexible loading machines with a long reach (at least 18 to 20 meters) and fast operating cycles using large grabs, magnetic sheets or the like. The requirements imposed on these loading machines in terms of flexibility are connected on the one hand with their use in working at the quayside for unloading ships at both high and low water and on the other hand in rapid transfer of the loading machine to another unloading point or to a stockyard which may even be a fair distance away (10 to 50 km).

Stationary loading machines or docks cranes are known from the prior art, which are installed on a steel or concrete pillar to a height of about 4 to 7 meters. Moreover, semi-stationary docks cranes are known which are arranged to be moveable on rails along the harbour. In addition, mobile transshipment apparatus traveling on endless tracks or drive wheels are know which can reasonably be move under their own power for short distances (up to about 5 km) . If the travel distances go beyond the short distances mentioned above the goods have to be transferred on to low-loaders. The dimensions of these latter transshipment apparatus are subject, at the transshipment height, to the existing restrictions imposed by heights of bridged, etc. In Germany, the traffic regulations impose a height of 4 meters including the low loader, which means that there is a maximum 3.7 m available for the loading height of the transshipment apparatus. Because of this dimensional restriction, these transshipment apparatus can only be used in a very limited way for unloading ships, as at high water when the ship is almost unloaded the side of the ship may be at a height of about 5 to 6 meters above the quay and the articulation axis of the transshipment apparatus should be at approximately the same height.

Another goods transshipment apparatus is known from the prior art which comprises a mobile substructure on which the superstructure with driver's cab, engine compartment and jib is mounted by means of a tubular pylon (steel column) at a height of 4 to 6 meters. This known goods transshipment apparatus is particularly suitable for use in unloading ships in harbour transshipment operations and on building sites, but it does have the disadvantage that it has to be built on site and can only be driven under its own power to very limited distances of not more than 2 to 4 kilometers—provided that there are no bridges, powerlines or the like in the way. A further disadvantage of this known goods transshipment apparatus is the fact that the maintenance, lubrication, refuelling, etc of the engine compartment integrated in the superstructure has to be done at a height of 4 to 6 meters. The maintenance staff of the known goods transshipment apparatus have to cover the distance between the substructure and superstructure by means of a long ladder. In addition, the superstructure has to be made secure by the provision of suitable railings.

UK patent 1,374,253 discloses a mobile tower crane comprising a mobile substructure with a tower crane pivotally mounted at its base on a platform of the mobile substructure to be tiltable between a vertical operating position and a substantially horizontal travelling position, with raising means interconnecting the tower and the platform for tilting the tower between said positions.

SUMMARY OF THE INVENTION

According to the invention, the superstructure of the goods transshipment apparatus according to the invention is constructed to be moveable between a lower position (resting position) on the substructure and an upper position (operating position) at a spacing from the substructure. This provision according to the invention increases the flexibility of a goods transshipment apparatus, as the adjustment of the position of the superstructure between a lower and an upper position on the one hand ensures that the jib is mounted high enough and thus meets all the requirements of length of reach, loading depth and degree of overload from the sides of ships, while on the other hand in the lowered position on the substructure the inherent mobility is improved and transportation on low-loaders is made possible. Furthermore, maintenance staff can comfortably climb into the driver's cab on the superstructure when it is in the lowered position and the refuelling and maintenance of the engine etc is also made easier in this lowered position.

Preferably, for the self-propelled travel of the goods transshipment apparatus according to the invention, a partly lowered position on the substructure is provided as the driving position, while the actual resting position for transportation on a low-loader, for maintenance, refuelling, access and egress of maintenance staff, corresponds to the fully lowered position.

Advantageously, the goods transshipment apparatus is constructed so that in the upper position (operating position) a vertical rotation axis of the superstructure extends substantially through the centre of the substructure in the case of an endless track drive or through the centre of the support for the substructure in the case of a wheeled drive, in order to ensure equal stability on all sides during operation, particularly when the superstructure is rotated.

According to an advantageous feature of the invention the superstructure is moved relative to the substructure by means of a connecting rod arrangement with control cylinders located between the superstructure and substructure. This is a mechanically simple but reliable and statically stable implementation of the inventive concept described above. It has proved particularly advantageous to construct the connecting rod arrangement as a pair of parallel connecting rods jointed on the one hand to the substructure and on the other hand to a subframe of the superstructure. The subframe of the superstructure is provided as a kind of intermediate frame to which the connecting rods of the connecting rod arrangement are jointed and on which the superstructure is rotatably mounted by means of a rotary mounting. Obviously, it is also theoretically possible to have an embodiment in which an adjustment device for adjusting the height of the superstructure acts directly on the superstructure and is jointed at the lower end to an intermediate frame which is rotatably mounted relative to the substructure. The parallel connecting rods of the connecting rod arrangement which constitutes the displacement device are preferably constructed as 4-point connecting rods, while it is also possible to have a combination in which one of the connecting rods is a 3-point rod while the other is a 4-point rod.

According to a particularly advantageous embodiment of the invention the superstructure is lowered into the lower position by pivoting the parallel connecting rods towards the rear of the goods transshipment apparatus. As a result the superstructure is lowered into a position in which it comes to rest above the rear part of the goods transshipment apparatus, making it possible to fold in the jib extending towards the front part of the goods transshipment apparatus over the front part of said apparatus and accommodate it there so as to take up the least possible height for the resting and shipping position. It has also proved advantageous for the engine compartment mounted on the superstructure to come to rest in a position located behind the substructure, in which it is directly accessible from several sides, thus making it much easier to carry out maintenance, refuelling and the like.

According to a further feature of the invention, the parallel connecting rod jointed in the rear part is jointed lower down than the parallel connecting rod jointed in the front area, and the parallel connecting rod jointed in the rear part is jointed to the superstructure on a portion of the subframe of the superstructure which slopes diagonally downwards. The part of the subframe of the superstructure which slopes diagonally downwards follows the geometry of the substructure and is constructed so that in the lowered bottom position of the superstructure, when a front horizontal portion of the subframe abuts or rests on the substructure it extends behind the rear of the substructure to the ground (travel surface) and thus provides maximum support and load relief for the parallel connecting rods. In addition, steps may be formed or provided on the portion of the subframe of the superstructure which extends diagonally downwards, to allow maintenance staff to gain easy access to the superstructure or driver's cab.

As a further feature of the invention the substructure has an endless track drive. Advantageously this is a telescopic caterpillar substructure with variable track width.

A telescopic caterpillar drive of this kind is knows from DE9319382 U1.

According to a particularly advantageous embodiment of the invention the angle of inclination of the parallel connecting rods in the upper position is between about 0° and about 20° to the vertical. An angle of inclination to the vertical of about 15° has proved particularly advantageous.

Alternatively, according to the invention, a goods transshipment apparatus is proposed having a substructure with wheeled drive with at least two wheel axles, with a superstructure with driver's cab and engine compartment mounted to be rotatable relative to the substructure, and with a jib or jib system jointed to the superstructure, wherein in order to support the goods transshipment apparatus in the operating position a least two support elements are provided which are capable of being lowered and the distance of the wheel axles from the rotation axis of the superstructure in the operational position corresponds at least to the spacing of a tilt line determined by the lowered support elements to the rotation axis. The distance of the wheel axles from the rotation axis of the superstructure extending perpendicularly thereto is thus greater than or equal to the spacing between a tilt line spanned by the lowered support elements and the rotation axis. The ideal tilt line corresponds to a circle described around the rotation axis, the radius of which corresponds to the length of the support from the longitudinal axis (central line) of the substructure to the edge of the support. The dimensional requirement of the goods transshipment apparatus according to the invention thus stipulates that the tilt lines must not intersect with the tilt circle described at any position of the 360° pivot of the superstructure.

According to a further feature of the invention the goods transshipment apparatus according to the invention with a superstructure which is moveable between a lower position on the substructure and an upper position at a spacing from the substructure comprises a wheeled drive.

In the case of a goods transshipment apparatus fitted with a wheeled drive the parallel connecting rod jointed in the rear part is advantageously bent so that it bridges the wheel axle provided in the rear part in the lowered bottom position.

According to another advantageous embodiment of the invention, two support elements are provided, capable of being lowered, which are arranged between the two wheel axles of a goods transshipment apparatus with wheeled drive.

According to another advantageous embodiment, four support elements capable of being lowered are provided, a first pair of which is provided on the end face of the substructure while a second pair is provided between the two wheel axles.

Further advantages and embodiments of the invention are described in the subsidiary claims and will be apparent from the description and the accompanying drawings.

It will be understood that the features mentioned above and those which will be described hereinafter may be used not only in the combination given but also in other combinations or on their own without departing from the scope and spirit of the present invention.

BRIEF DESCRIPTION OF THE DRAWINGS

The invention is schematically shown in the drawings with reference to a number of embodiments and is described in more detail hereinafter with reference to the drawings, in which.

DETAILED DESCRIPTION

Figure 1:
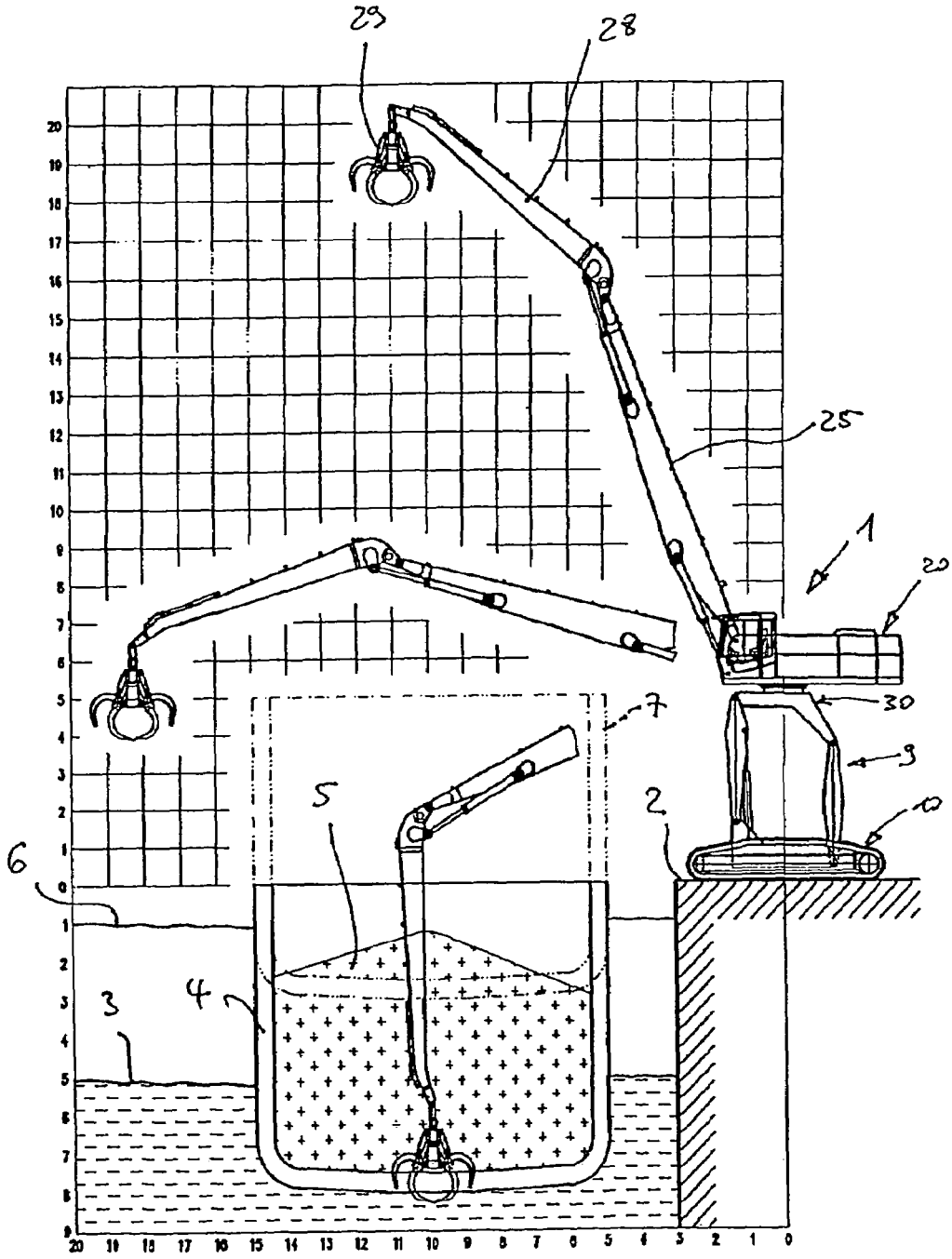
FIG. 1 shows a goods transshipment apparatus according to the invention against the background of a scale grid (metre grid) in the operating position on a quayside wall.

FIG. 1 shows a first embodiment of a goods transshipment apparatus 1 according to the invention. The goods transshipment apparatus a according to the invention (hereinafter referred to ad loading apparatus for short, in the interests of simplicity) comprises a substructure 10 which travels on endless tracks and a superstructure 20. The superstructure 20 comprising a driver's cab 21, an engine compartment 22, a chamber 23 for hydraulics and a tail weight 24 is mounted on a subframe 30 by means of a rotary mounting 27 (cf also FIG. 2 which shows a partial side view of the loading apparatus 1 according to the invention) . Also jointed to the superstructure 20 is a jib 25 with a loading arm 28 and grab 29 on a jib mounting shaft 8. Obviously, it is also possible to use jib systems other than that shown, e.g. having more jib combinations.

According to the invention, the superstructure 20 is mounted at a height of about 5–6 meters from the substructure 10. This spaced arrangement is achieved by means of a connecting rod arrangement 9 by means of which the superstructure 20 can be lowered according to the invention into a lower position on the substructure 10. The precise method of operation of the invention is described in more detail hereinafter with reference to FIGS. 2 to 8.

In addition, FIG. 1 shows the possible uses of a loading apparatus according to the invention, taking as an example its use in dockside transshipment on a quayside wall 2. In front of the quayside wall 2 is a freight-carrying ship the stern 4 of which containing goods 5 for loading is diagrammatically shown in section. At low water 3 and fully laden the side of the stern 4 is at roughly the same height as the quayside wall 2. At high water 6, on the other hand (and particularly as unloading progresses) the stern of the ship is raised to the position 7 shown by dotted lines. In order to be able to operate with the loading apparatus 1 while the stern of the ship is in the raised position 7, the jib mounting 8 (cf FIG. 2) must be located high enough above the quayside wall 2. The metre grid shown in the drawing indicates a height of about 6 meters for this purpose. For reasons of visibility the operator's eye level must also be at a similar height.

Figure 2:
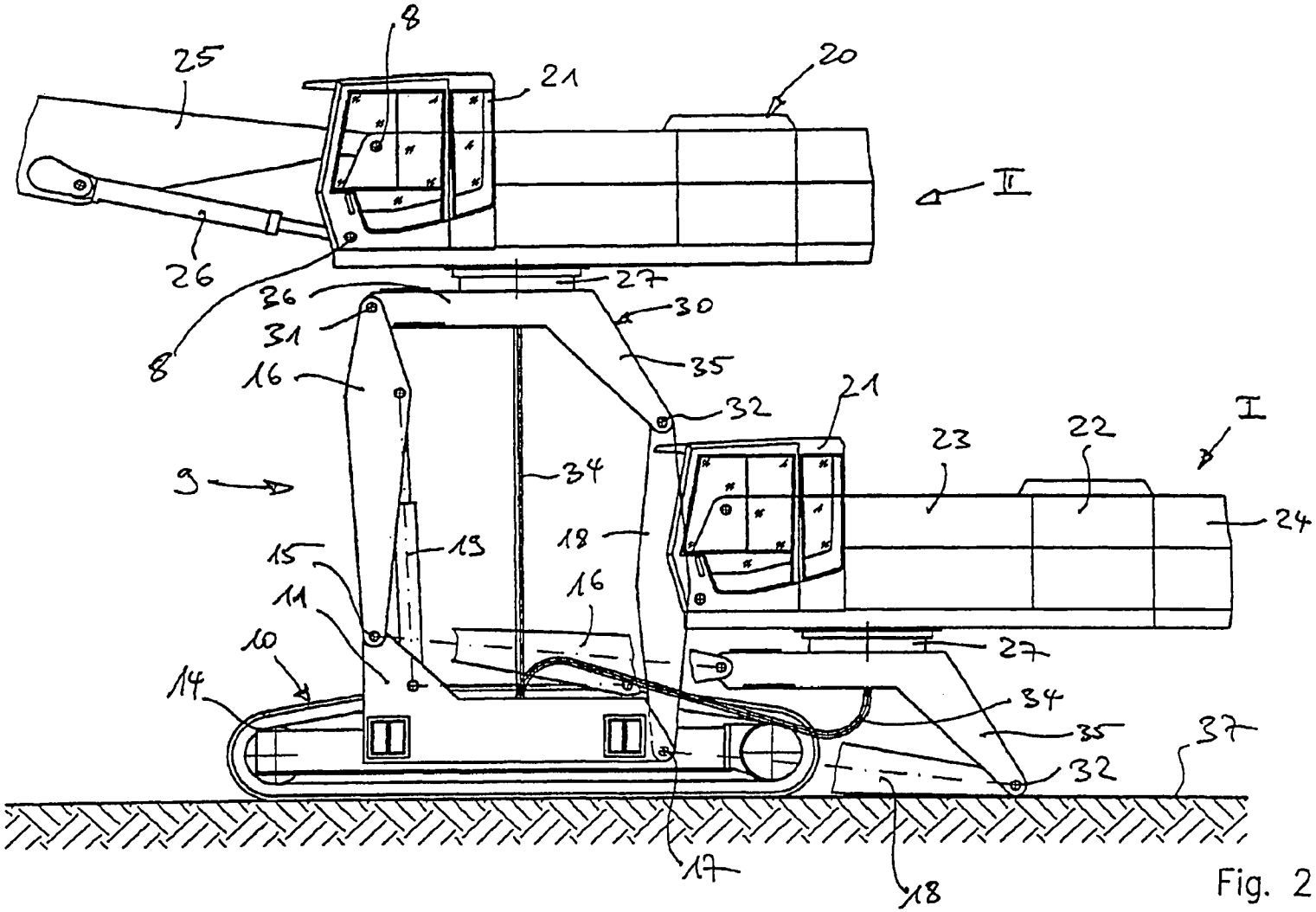
FIG. 2 shows the goods transshipment apparatus according to the invention of FIG. 1 in partial side elevation, in the working position and lowered to the lower position.

FIG. 2 shows both the lowered lower position (resting or shipping position) I and also the raised upper position (operating Position) II to illustrate the method of operation and function of the invention. The superstructure 20 of the loading apparatus 1 according to the invention is raised and lowered by an adjusting device which in the embodiment shown consists of a hydraulically operated connecting rod arrangement 9. To give a clear illustration of the mode of operation of the connecting rod arrangement according to the invention, FIG. 2 shows a cut-away view of a an endless track compartment 13 of the endless track-driven substructure 10 facing towards the observer.

The connecting rod arrangement 9 comprises a pair of parallel connecting rods 16, 18. The two parallel connecting rods 16, 18 forming the pair of parallel connecting rods are jointed at their lower ends to a central undercarriage member 11 of the substructure 10 and at their upper ends to the subframe 30 of the superstructure 20. A first parallel connecting rod 16, a so called 4-point connecting rod (cf FIG. 3), is jointed in a front part of the substructure 10 to a front connecting rod spindle 15 on the central member 11, while a second parallel connecting rod 18, which is a so-called 3-point connecting rod (cf FIG. 4), is hinged to a rear connecting rod spindle 17 on the central member 11 in the rear part of the substructure 10.

The two parallel connecting rods 16, 18 are of the same length but in order to improve the geometry of pivoting, particularly with regard to the position of the connecting rods and the superstructure in the lowered position, they are hinged to the central member 11 at different heights. In the embodiment shown and under discussion, the superstructure is lowered by pivoting the parallel connecting rods 16, 18 towards the rear of the substructure 10. For this reason the front parallel connecting rod 16 is hinged higher up and the rear parallel connecting rod 18 is hinged lower down.

As the parallel connecting rods 16, 18 are the same length, consequently the jointing of the parallel connecting rods 16, 18 to the superstructure 20 or to its subframe 30 must also be carried out at different heights. As can be seen from FIG. 2, for this purpose the subframe 30 has two sections, namely a first horizontally extending section 36 on which the rotary mounting is provided for mounting the superstructure so as to be fully rotatable, and a second section 35 which extends diagonally downwards towards the rear of the loading apparatus 1. The front parallel connecting rod 16 is jointed to a rear connecting rod axis 32 of the subframe on the downwardly extending section 35. The section 35 of the subframe 30 of the superstructure extending diagonally downwards is constructed in its geometry so that the difference in height is balanced out in the jointing of the two parallel connecting rods 16, 18.

Moreover, the connecting rod arrangement 9 is designed so that—as may be seen in FIG. 2—in the lowered position I of the superstructure 20 the parallel connecting rods 16, 18 rest on the substructure 19 or on the ground (travelling surface) 37, while the end of the downwardly extending section 35 of the subframe 30 of the superstructure also rests on the ground 37 in the region of the articulation axis 32.

Although the skilled man can select any suitable geometry for parallel connecting rods, it is considered advantageous within the scope of the present invention to make the front parallel connecting rods 16, driven by a pair 19 of control cylinders, as 4-point connecting rods of maximum width in order to transmit rotational and tilting forces from the intermediate frame of the subframe 30 of the superstructure into the central member 11 of the undercarriage. The second, non-driven connecting rod 18 jointed in the tail region is advantageously constructed as a 3-point connecting rod so that it acts on the subframe 30 at a point (connecting rod axis 32) such that the length tolerances which occur with components of this order of magnitude (the connecting rod being about 3 to 3.50 m long) are compensated.

Figure 3:
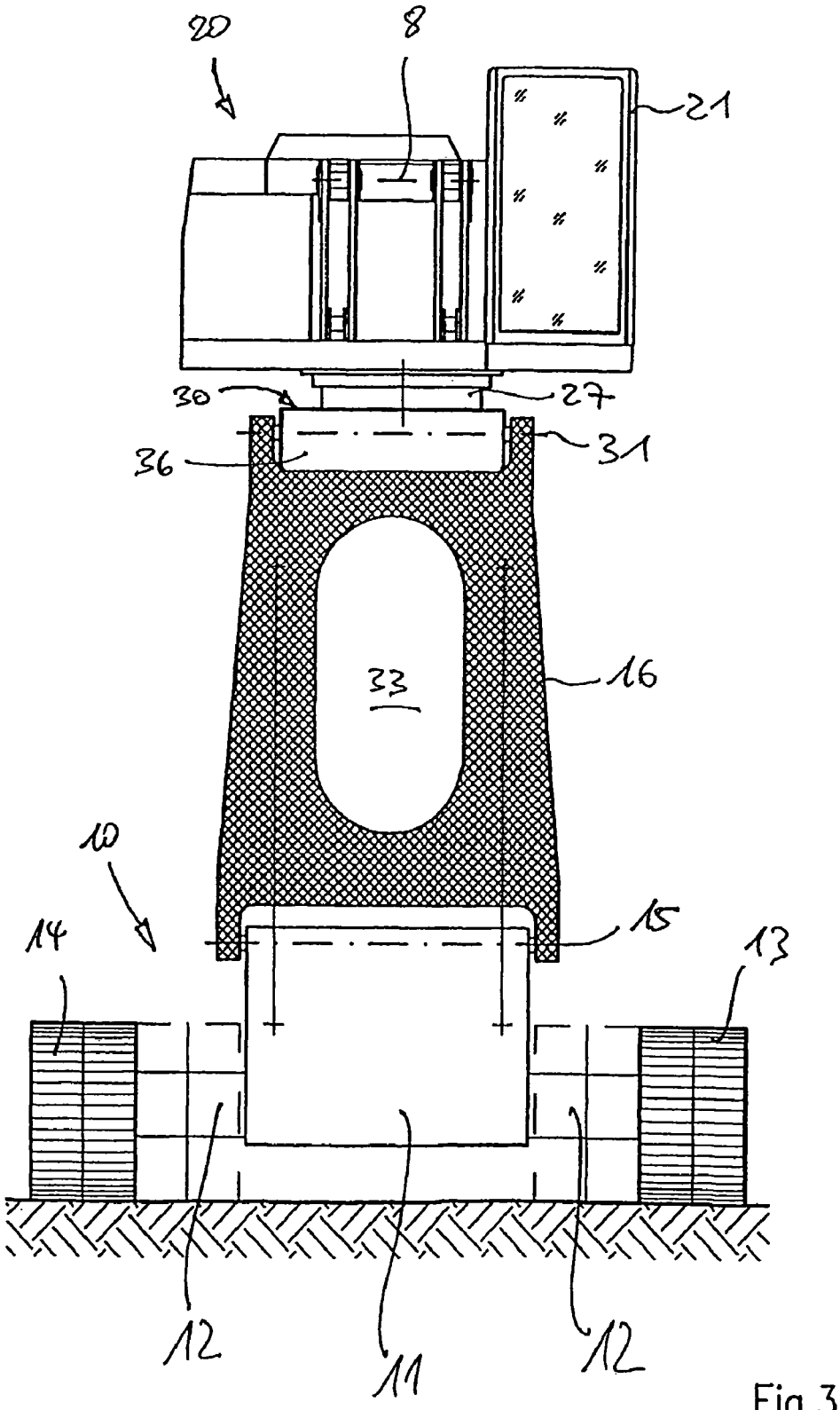
FIG. 3 shows the goods transshipment apparatus of FIG. 1 according to the invention in the operating position in front view looking towards the front parallel connecting rods constructed as 4-point connecting rods.
Figure 4:
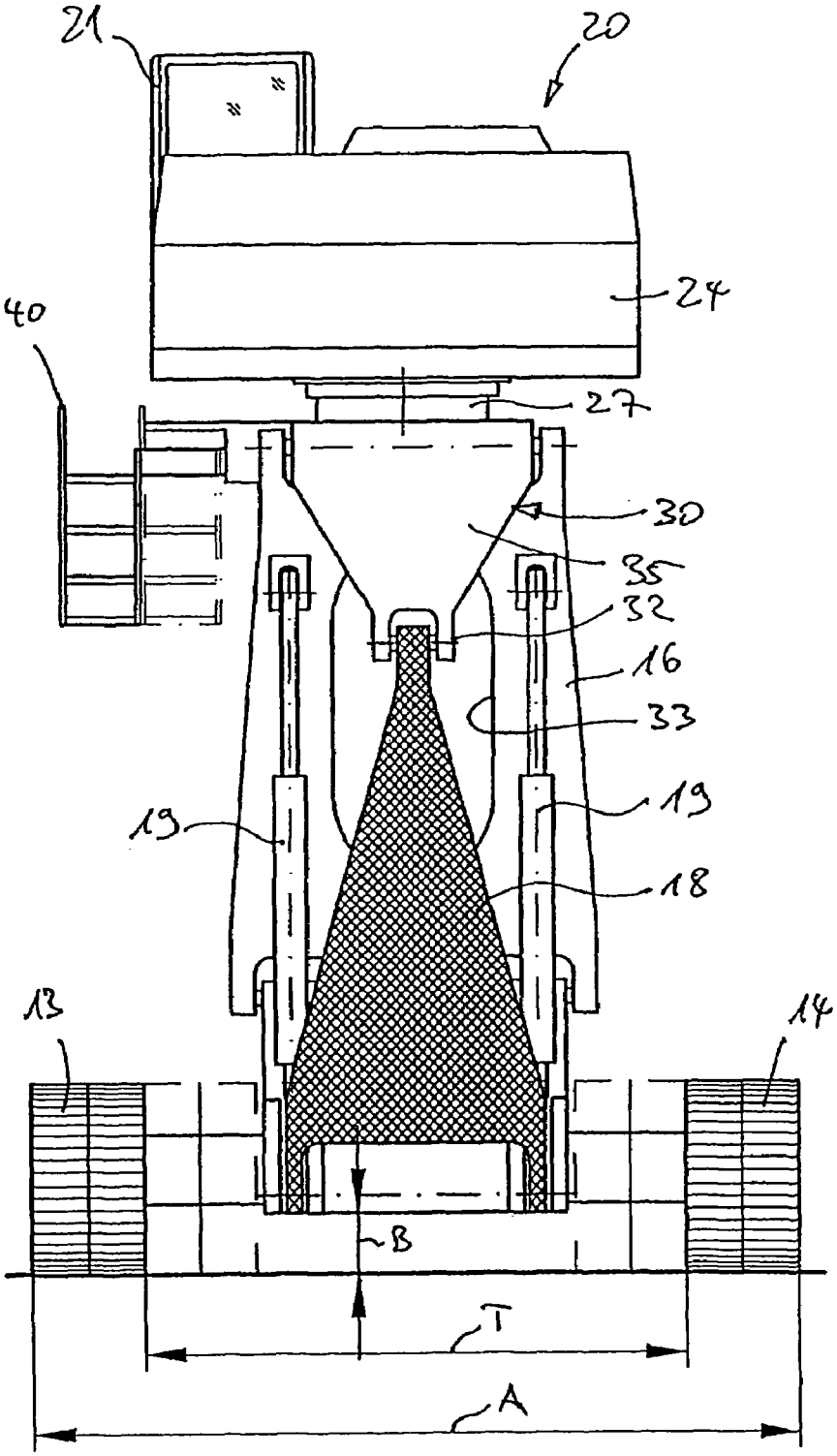
FIG. 4 shows the goods transshipment apparatus of FIG. 1 according to the invention in the operating position in rear view, looking towards the rear parallel connecting rods constructed as 3-point connecting rods.
Figure 5:
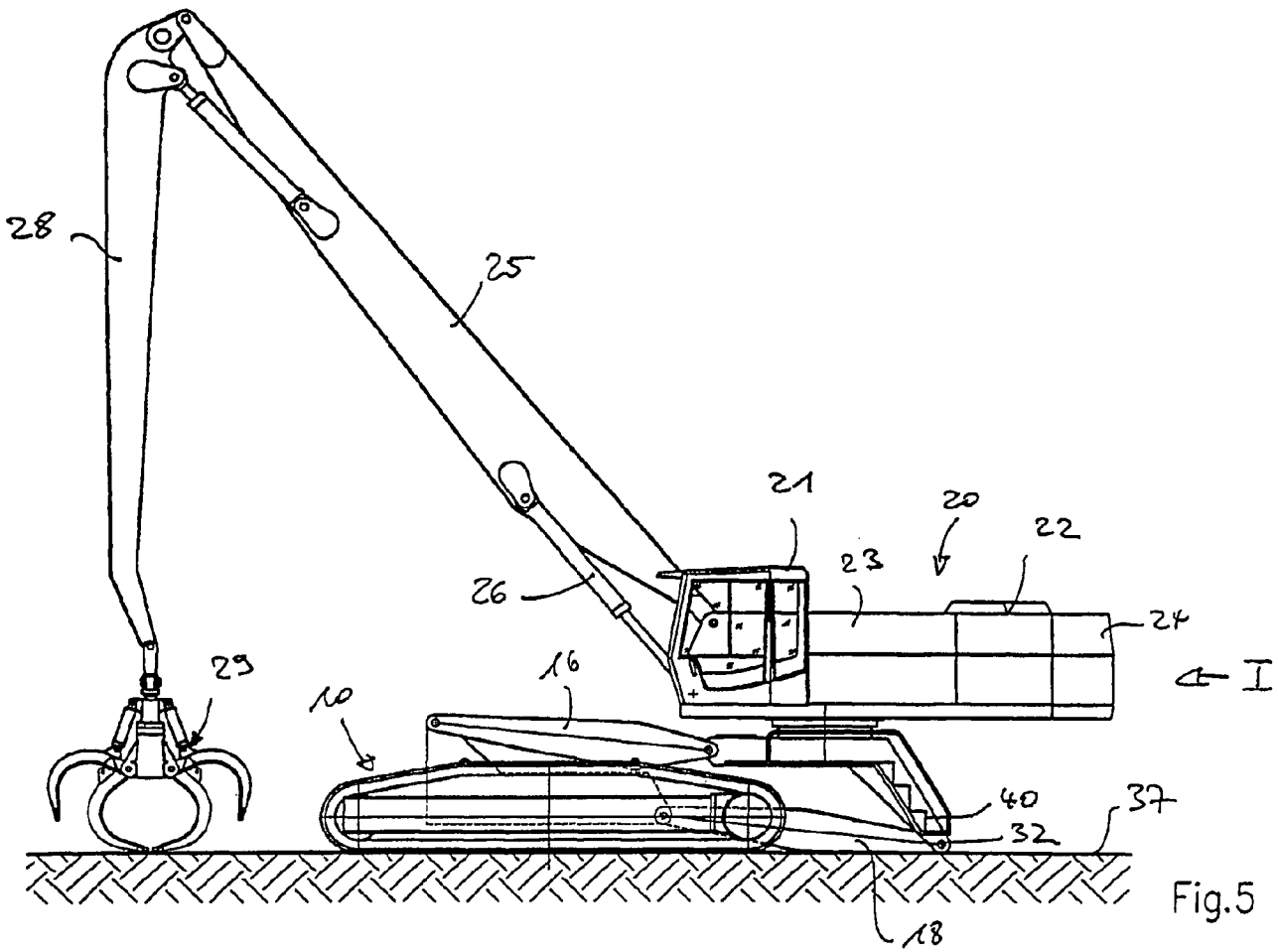
FIG. 5 shows the goods transshipment apparatus of FIG. 1 according to the invention in overall side view in the lowered resting or maintenance position.
Figure 6:
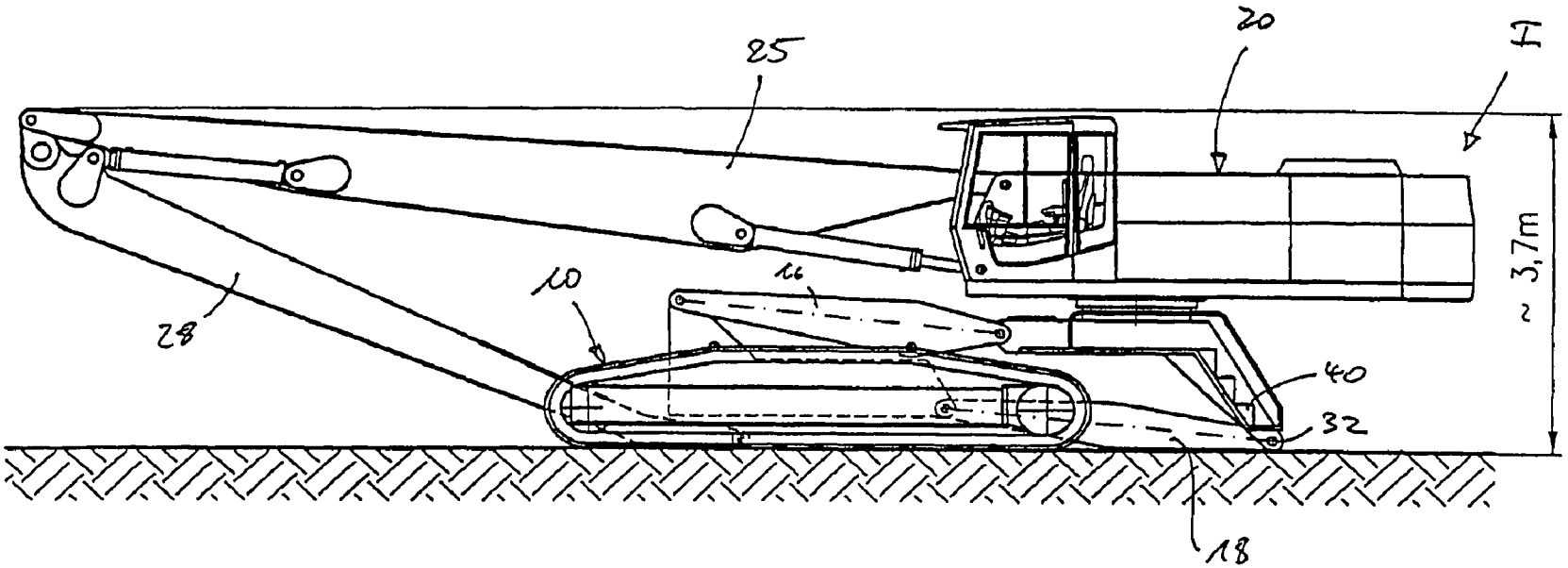
FIG. 6 shows the goods transshipment apparatus of FIG. 1 according to the invention in overall side view in the lowered resting or shipping position.

FIGS. 3 and 4 show the loading apparatus 1 according to the invention in front view (FIG. 3) and in rear view (FIG. 4) FIGS. 3 and 4 in particular show the arrangement of the endless track drive of the substructure 10 with caterpillar tracks 13, 14. The endless track drive is preferably a telescopic endless track drive using telescopic guides 12 so that the track width of the endless tracks 13, 14 is adjustable, thus making it possible to adjust between the most compact possible transportation state (transporting width T) and an operational state which gives greater stability (operating width A) (cf FIG. 4) . The transporting position of the endless tracks 13, 14 is shown by dotted lines in FIGS. 3 and 4. The telescopic guides 12 are shown purely diagrammatically, nor is there any more detailed description of the telescopic adjustment of the endless tracks 13, 14 as this is known per se from the prior art. The front parallel connecting rod 16 preferably has a recess 33 (cf FIGS. 3 and 4) which helps to reduce the weight and provides a space for hose connections 34 running from the superstructure 20 to the substructure 10 (cf FIG. 2) . In order to make it easier for maintenance staff to climb into and our of the driver's cab 21 located on the superstructure 20, an access ladder 40 as shown in FIGS. 4 and 5 may be provided, which is arranged on the superstructure 20, or more precisely on the subframe 30 of the superstructure 20, in such a way that in the lowered state (lower position I) its bottom step is somewhat above the ground 37. It has proved particularly advantageous to construct the access ladder 40 to be telescopic, so that it can be moved analogously to the telescopic endless track drive between the operating position and the transporting position in which it does not extend laterally beyond the outer dimensions of the superstructure (cf FIG. 4) . However, maintenance staff can also gain access by means of the endless tracks 13 if no access ladder is provided.

FIG. 5 shows the loading apparatus 1 of FIG. 1 according to the invention in an overall side view in the lower position I, which is the position in which the operator climbs in and out and the maintenance position for refuelling, lubrication, etc. By contrast, FIG. 6 also shows, in an overall side view, the lower position I of the loading apparatus 1 according to the invention in the shipping position with the jib folded inwards for a so-called low-bed truck. In this shipping position the jib 24 with the loading shaft 28 is lowered and folded in to such an extent that its highest point protrudes only slightly, if at all, beyond the roof of the driver's cab 21 and does not exceed a height of about 3.70 m. Obviously, in the shipping position, the caterpillar drive is also retracted to the transporting width T.

Figure 7:
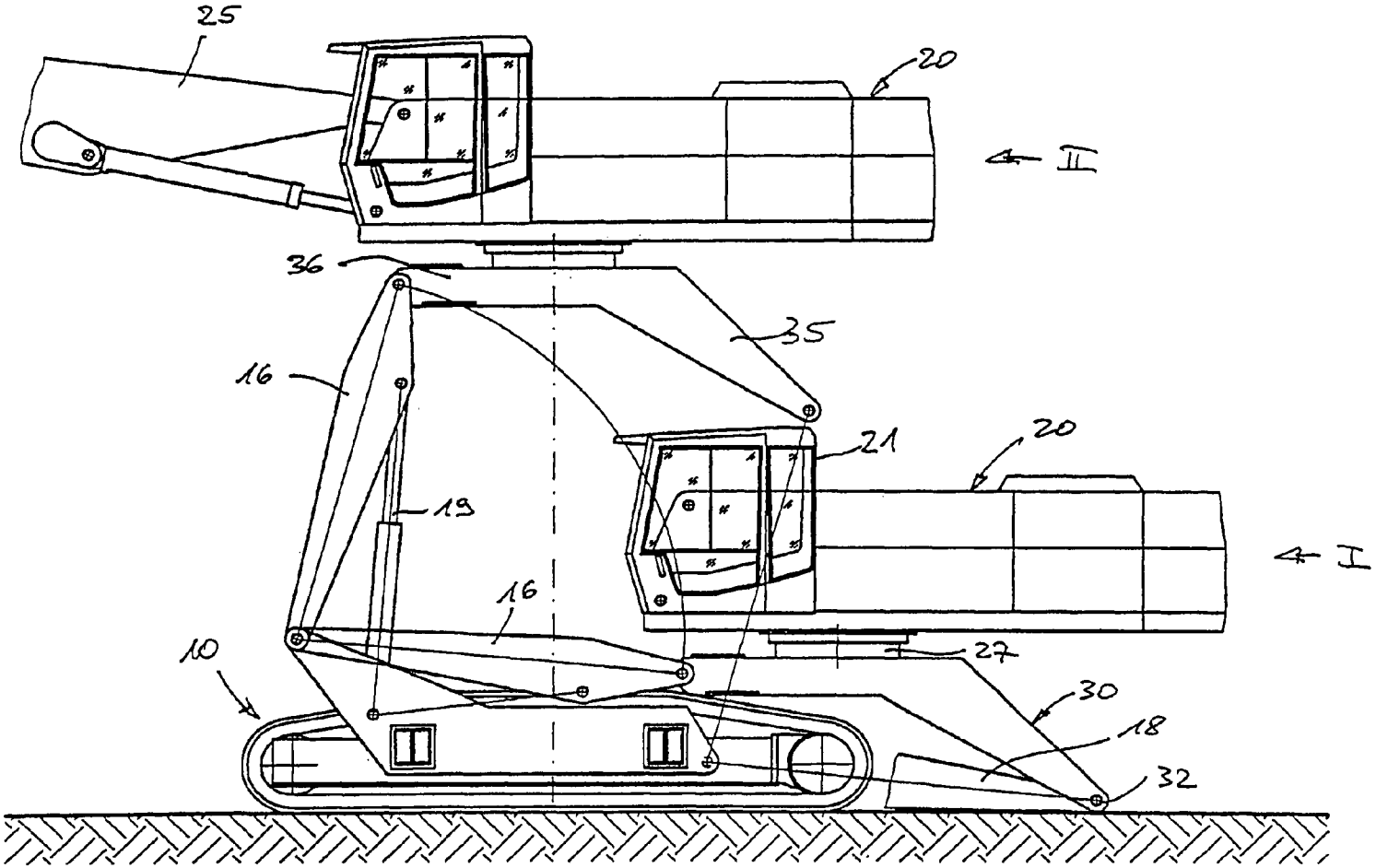
FIG. 7 shows a partial side view of a second embodiment of a goods transshipment apparatus according to the invention both in the working position and in the lowered resting position.

Finally, FIG. 7 shows another embodiment of a loading apparatus according to the invention wherein, by contrast to the first embodiment shown in FIGS. 1 to 6, the parallel connecting rods 16, 18 in the top position II of the superstructure 20 are not perpendicular but slightly inclined towards the tall of the loading apparatus. In the embodiment shown, this inclination is about 15°. Apart from improving the pivoting movement of the parallel connecting rods 16, 18 relative to the position of the superstructure in the lowered position (in the embodiment in FIG. 7 the rotation axis 27 is located in the substantially above the centre of the rear endless track drive wheel, whereas in the embodiment shown in FIG. 2 it is significantly behind the endless track drive) . A further advantage of the slight inclination of the parallel connecting rods 16, 18 in the upper position is that, in the event of an emergency situation in which the control of the lowering system fails or something happens to the operator in the driver's cab, the superstructure 20 can be lowered by gravity into the lower position 1 simply by opening the hydraulic system of the control cylinders 19 from the ground.

In both embodiments, the loading apparatus is preferably controlled so that (total) pivoting of the superstructure 20 about the perpendicular axis 20 is only made possible when the superstructure 20 has reached its operating position and the two endless tracks 13, 14 are in their extended operating width, to ensure adequate stability. If the substructure has a wheeled drive, the rotation of the superstructure would only be freed analogously when corresponding support legs had been extended in order to improve the stability. If the operator wishes to lower the superstructure 20 in order to climb out, then in a counter move the longitudinal axis of the superstructure 20 with the jib 28 has to be brought into congruence with the longitudinal axis of the substructure 10, while the front of the superstructure 20 (jib side) must face towards the front of the substructure 10 as shown in the drawings, i.e. in the direction of the driven parallel connecting rod 16. Only then do the control cylinders 19 allow lowering from the upper position into the lower position.

Figure 8:
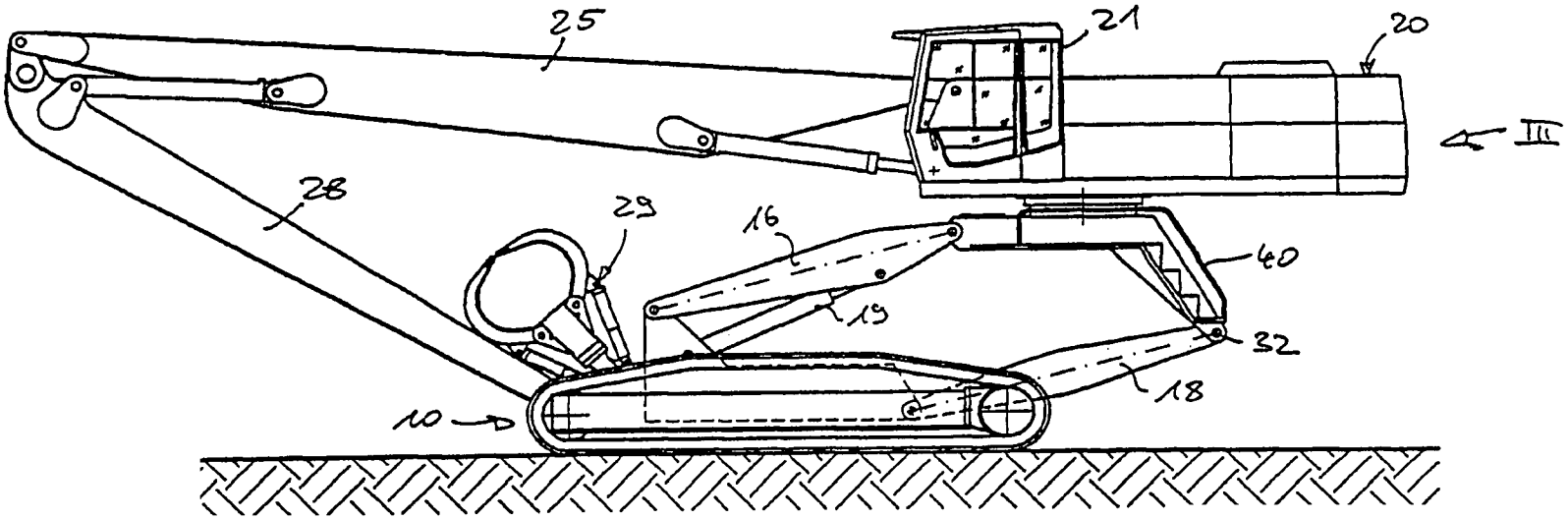
FIG. 8 shows the goods transshipment apparatus according to the invention in a partially lowered self-propelled driving position.

Moreover, there may be an intermediate position corresponding to a driving position 3 of the superstructure as shown in FIG. 8, wherein the section 35 of the subframe 30 of the superstructure, which extends diagonally downwards, does not rest on the ground 37 but is located approximately at the level of the top edge of the caterpillars 13, 14. In this driving position the loading apparatus can be driven with its own drive (the superstructure being prevented from rotating), in order to minimise its height on difficult terrain or for going under bridges and to keep the centre of gravity of the apparatus as a whole low.

Figure 9:
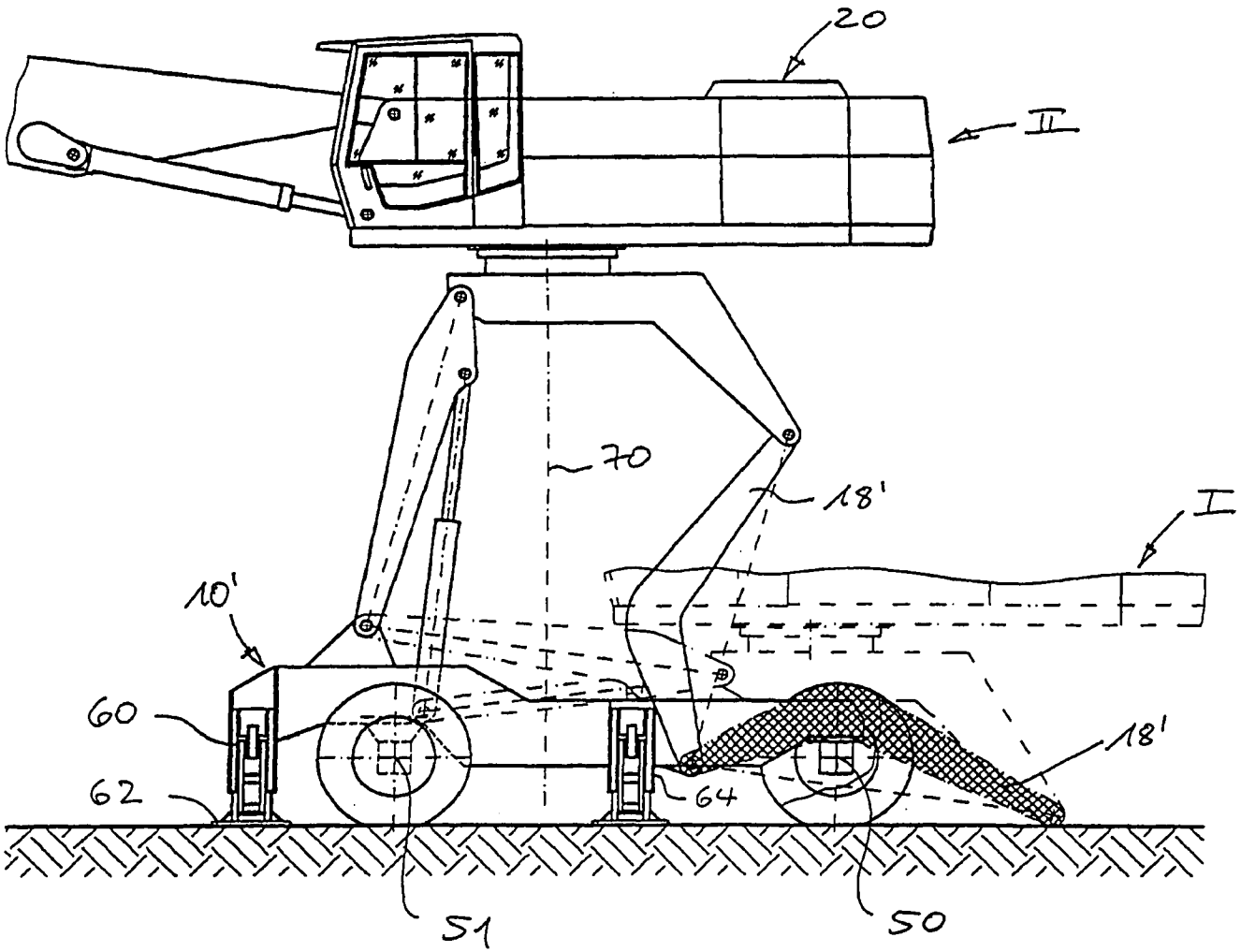
FIG. 9 shows a third embodiment of a goods transshipment apparatus according to the invention with wheeled drive and so called 4-point claw support.

FIG. 9 shows another embodiment of a goods transshipment apparatus according to the invention with a wheeled drive. The wheeled drive of the goods transshipment apparatus comprises two wheel axles 50, 51, namely a fixed axle 50 provided in the rear part of the substructure 10' and a swivelling axle 51 arranged in the front part of the substructure 10'.

Figure 11:
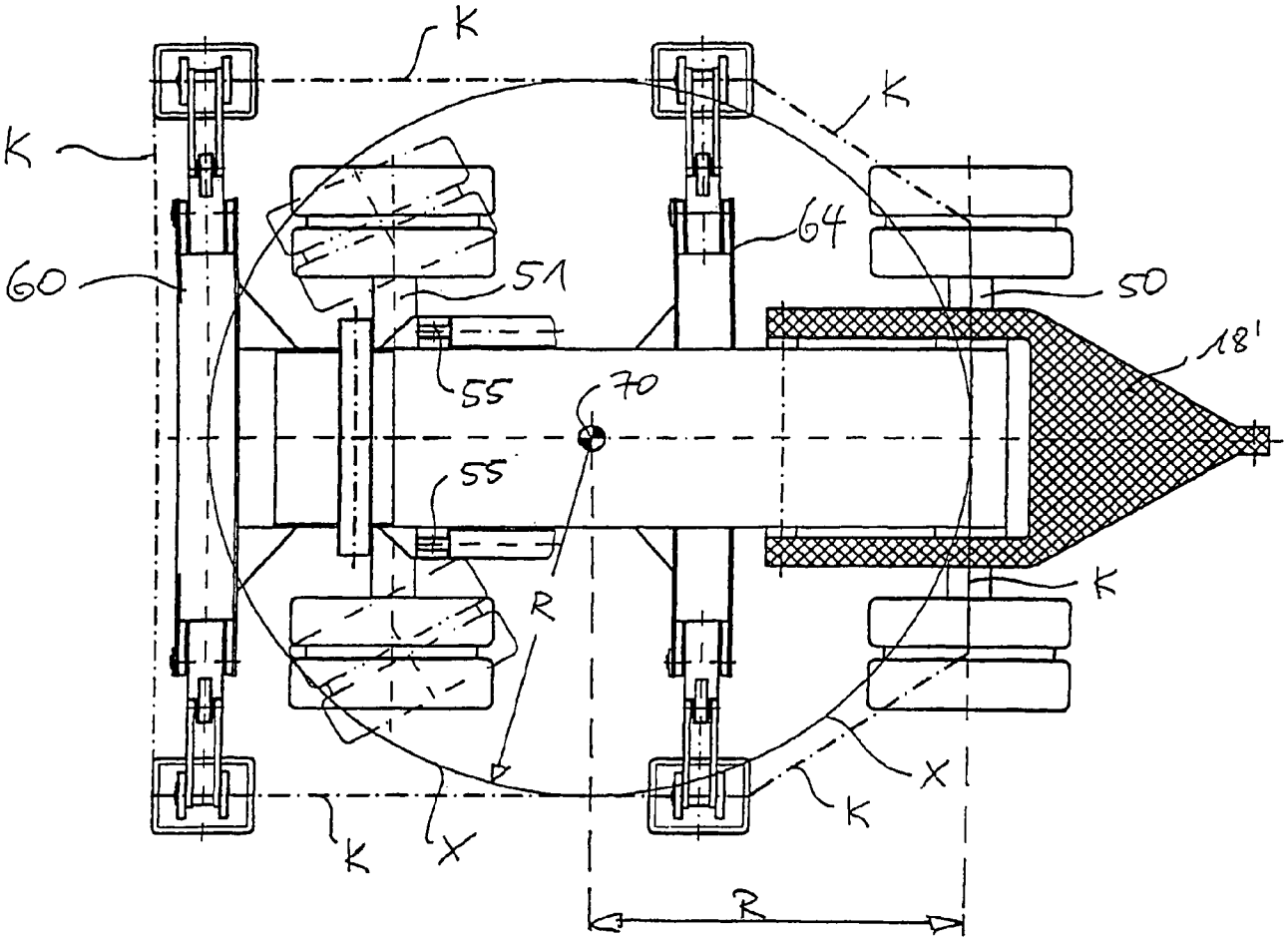
FIG. 11 shows a plan view of the substructure of the goods transshipment apparatus in FIG. 9.

Moreover, the goods transshipment apparatus comprises claw supports 60, 64 fixed to the substructure 10', a first pair 60 of which are provided on the end face of the substructure 10' while a second pair 64 are provided between the two wheel axles 50, 51. According to the invention the spacings and dimensions are such that at least one of the wheel axles (the rear fixed axle 50 in the embodiment shown) is at a spacing from the rotation axis of the superstructure in the operating state, i.e. in the upper position II, which is greater than or equal to the spacing of a tilt line K from the rotation axis 70 of the superstructure (cf also FIG. 11). The ideal tilt line is an (imaginary) circle X described about the rotation axis 70 with a radius R, which corresponds to the length of the support from the central line (longitudinal axis) of the substructure to the tilt line K which is defined by the lowered support claws. The tilt line K must not intersect the tilting circle X at any position of the swivelling of the superstructure through 360° about the rotation axis 70.

Figure 10:
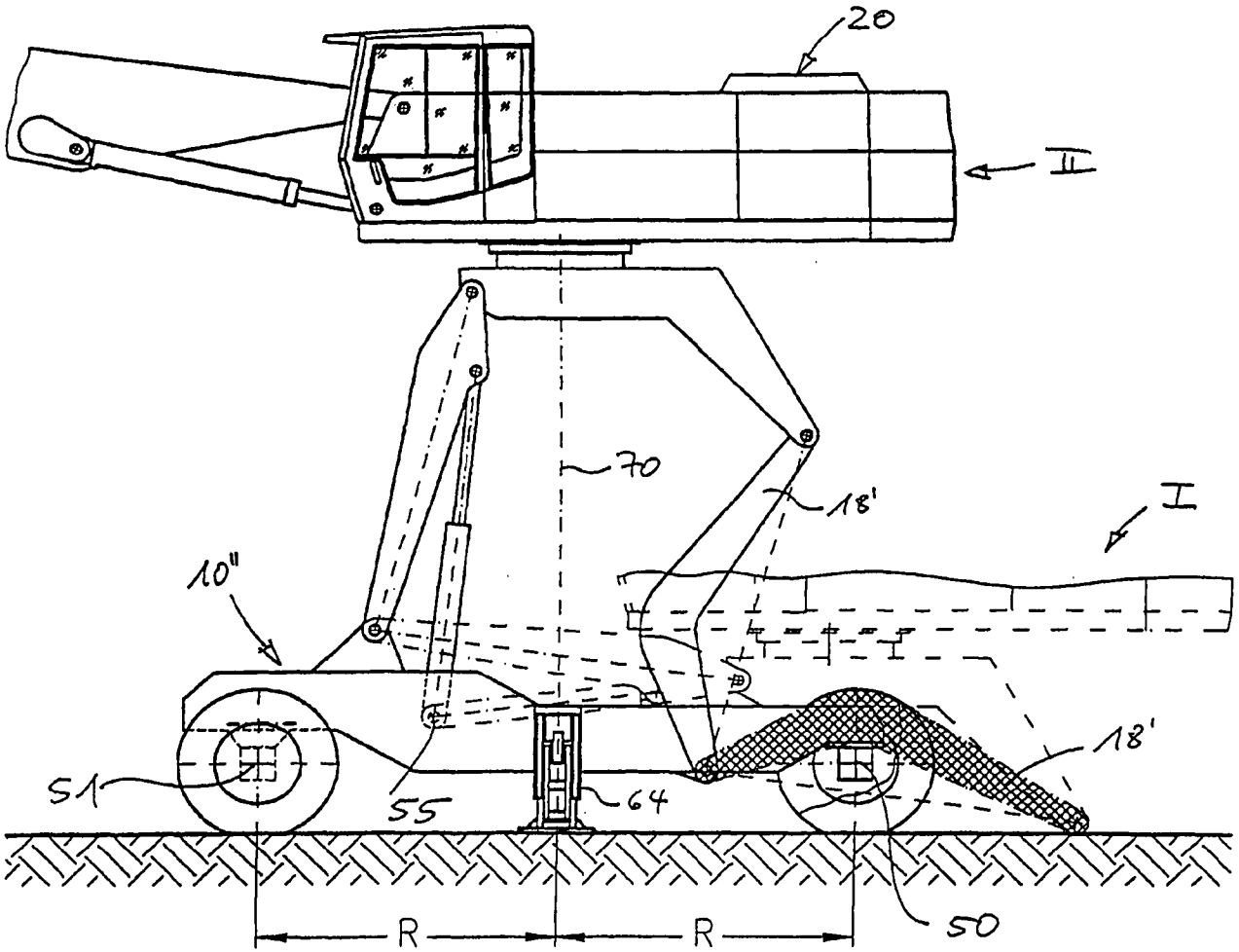
FIG. 10 shows a goods transshipment apparatus similar to that of FIG. 9, with wheeled drive and a longer wheel base and 2-point claw support.
Figure 12:
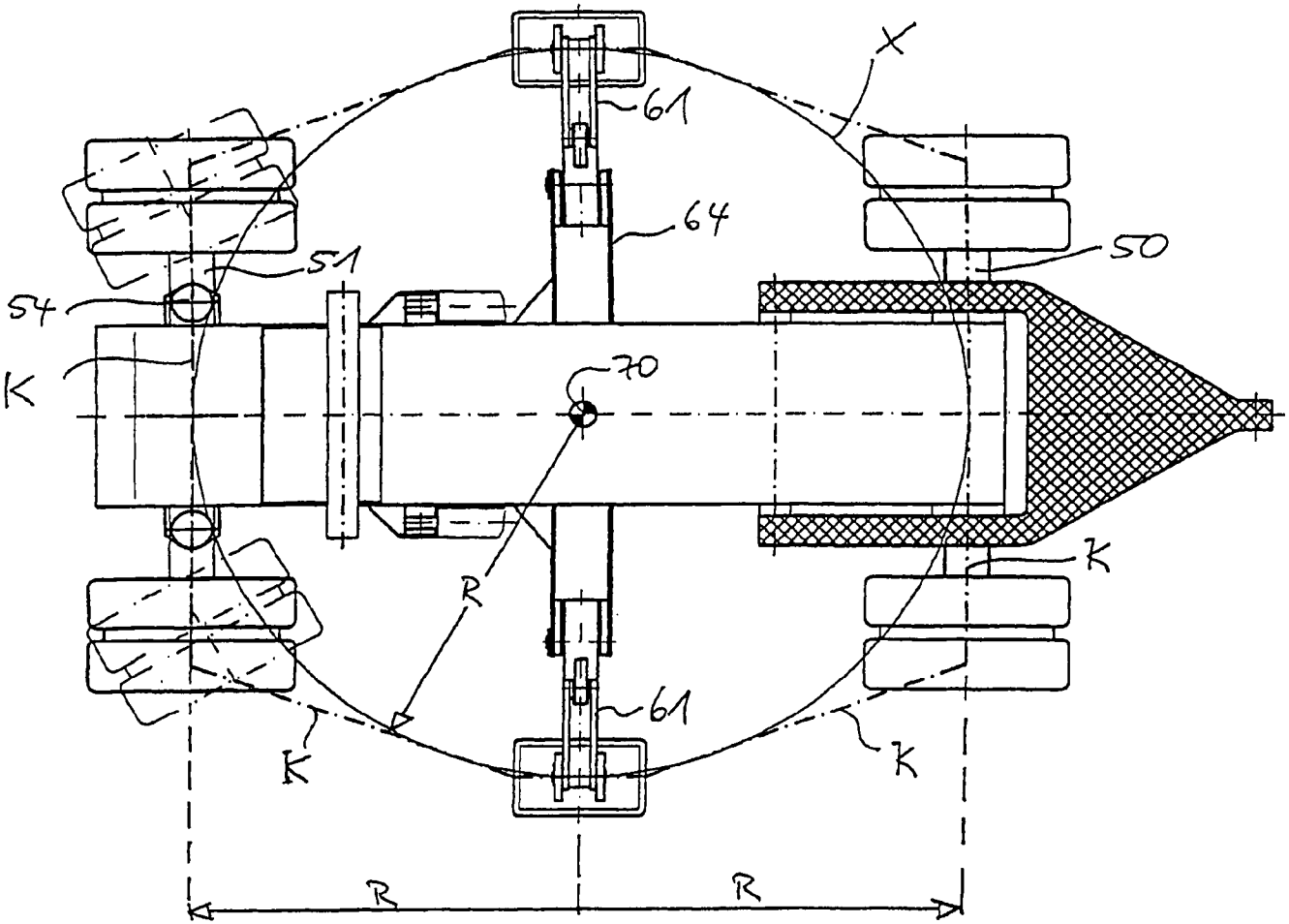
FIG. 12 shows a plan view of the substructure of the goods transshipment apparatus in FIG. 10.

FIG. 10 shows, in a similar embodiment by way of example, another goods transshipment apparatus with wheeled drive which has a longer wheel base between the two axles 50, 51 and has only one pair of claws 64 for support, mounted between the two axles 50, 51. The arrangement is such that the spacing of the two axles 50, 51 from the axis spanned by the two claws 61 is greater than or equal to the radius R as defined hereinbefore (cf also FIG. 12).

The arrangements described above achieve a degree of stability to the goods transshipment apparatus which enables the superstructure to be moved between a lower position I and an upper position II. The substructures with wheeled drive described above are particularly necessary if the goods transshipment apparatus is used on a surface finished with a tar coating, paving, asphalt or the like, which could be damaged by a caterpillar drive. On demolition or reconstruction projects in the city, in particular, endless tracks would cause too much damage to roads or finished surfaces. The goods transshipment apparatus according to the invention have safe all-round support for use in such areas.

As can be seen from FIGS. 9 and 10 in particular, the parallel connecting rod 18' jointed in the tail region of the substructure 10' (so called triangular connecting rod) is constructed with a bend such that the triangular connecting rod 18' in the lowered position bridges the wheel axle 50 in the tail region and preferably has its end remote from the vehicle resting on the ground, thus providing support.

Figure 13:
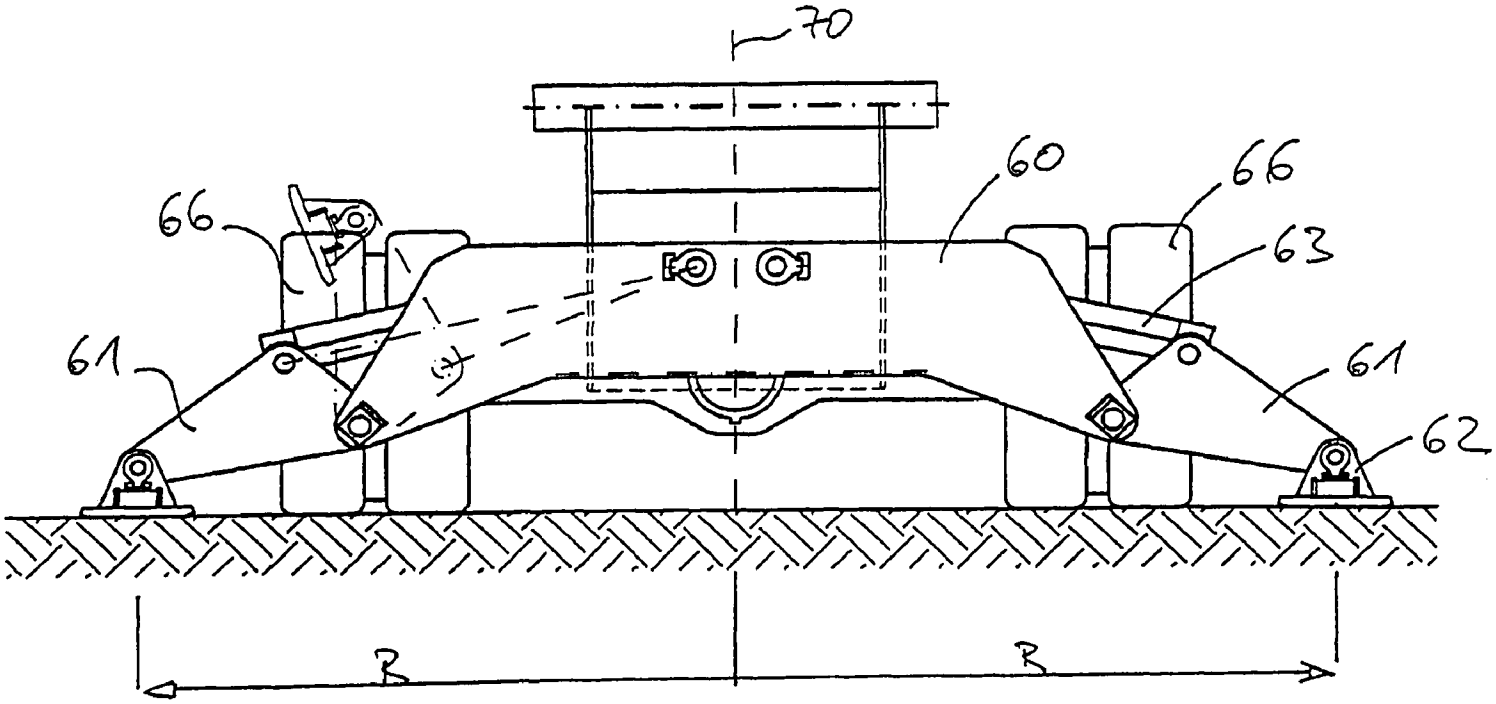
FIG. 13 shows a view of the substructure of the goods transshipment apparatus of FIG. 1 from in front, with the claws lowered.

FIG. 13 shows a front view of a claw support means 16 with two claws 61 capable of being lowered, which rest on the ground 62 by means of baseplates 62 and thus provide support for the goods transshipment apparatus. In the raised position (shown by dotted lines on the left in FIG. 13) the claws 61 are located within the transporting width of the goods transshipment apparatus defined by the wheels 66.

Preferably, support cylinders 63 (cf FIG. 13) limit the support force acting on the baseplates 62 of the support claws 61. This pressure limitation prevents the fixed axle 50 in the embodiment shown in FIG. 9 and the two axles 50, 51 in the embodiment shown in FIG. 10 from lifting up off the ground and being unavailable as an (additional) support element in the operational state. This is particularly important as, if the axles were to lift up off the ground, they would no longer act as a tilt line. The claw supports shown may also be replaced by so-called telescopic supports which extend perpendicular hydraulic rams to a dimension R (or more).

Figure 14:
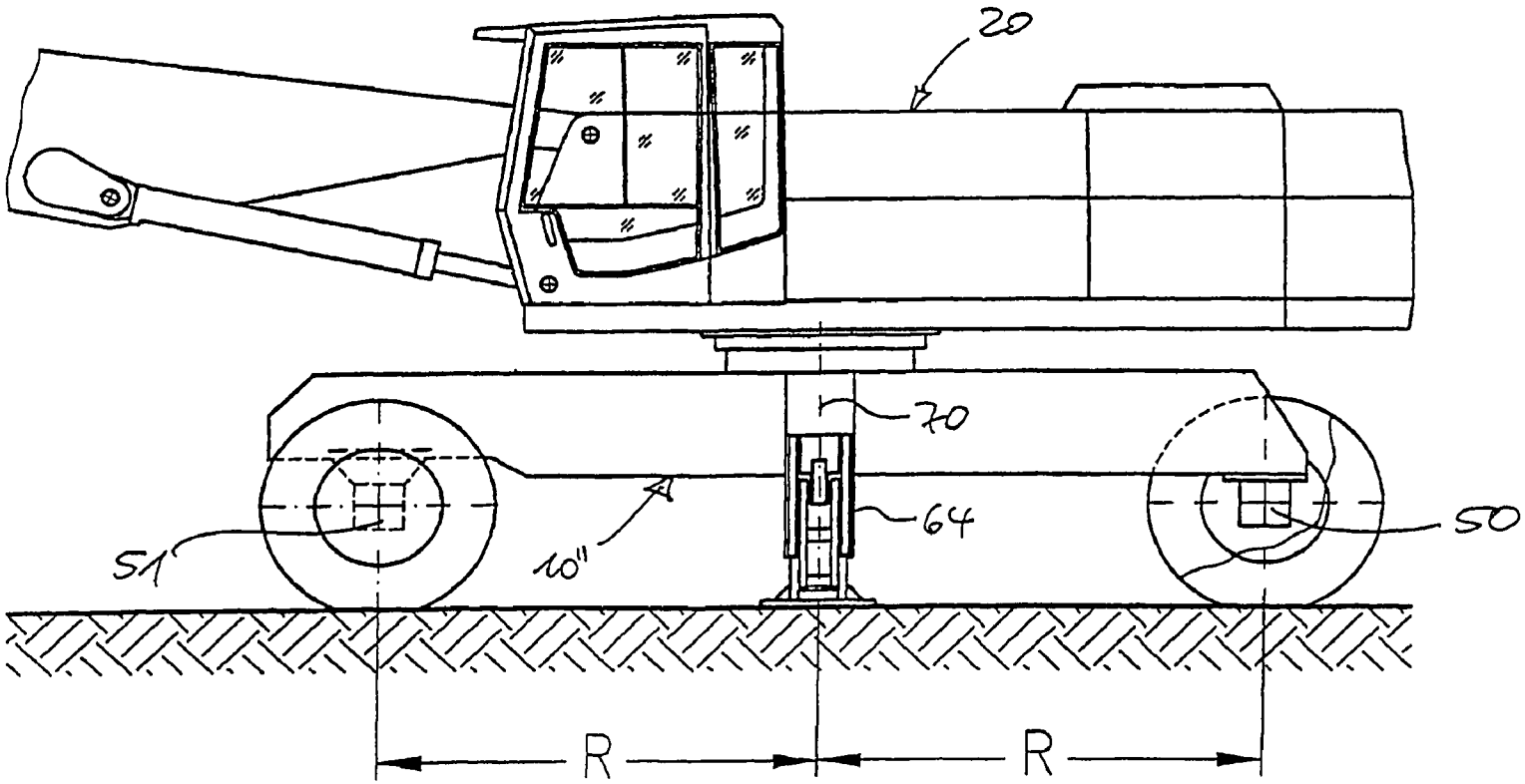
FIG. 14 shows, as a further embodiment by way of example, a goods transshipment apparatus according to the invention with the superstructure placed directly thereon and 2-point claw support.

FIG. 14 shows a support according to the invention for a wheel-driven substructure which may also be used for a goods transshipment apparatus in which the superstructure 20 is mounted directly on the substructure 10". Here again the arrangement ensures that the two wheel axles 50, 51 act as support elements.

Figure 15:
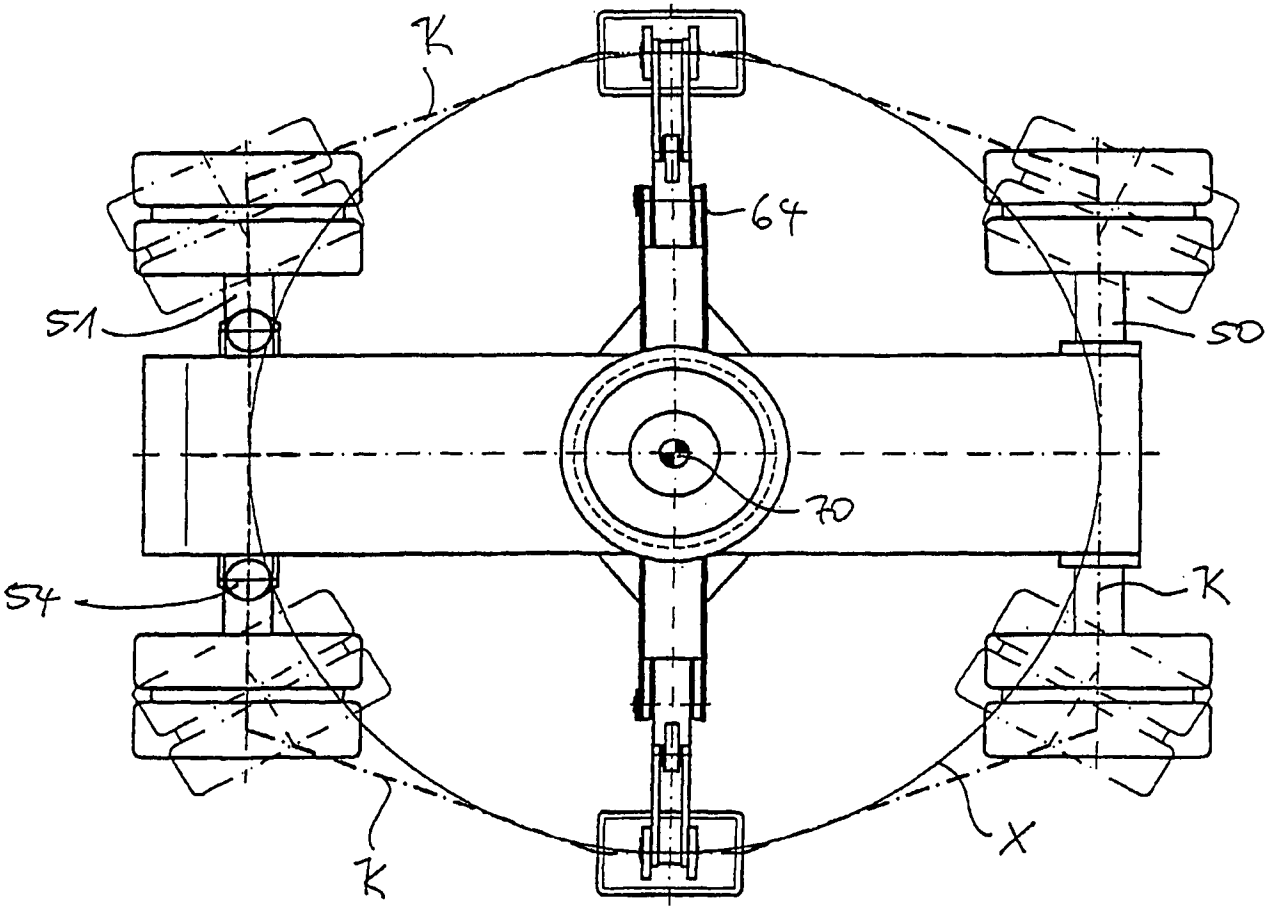
FIG. 15 shows the substructure of the goods transshipment apparatus of FIG. 14 in plan view.

FIG. 15 shows a plan view of the substructure of the goods transshipment apparatus of FIG. 14. As in the illustration in FIG. 12, an inherently hydraulic locking means 54 for the swivelling axle is provided, which is wired so that the operational functions in the superstructure are not freed up until the swivelling axle 51 is supported and locked by the swivelling axle locking means. The supporting and axle locking may be controlled by simple pressure sensors.

Thus, the invention provides a goods transshipment apparatus wherein the disadvantages known from the prior art can be overcome using a known hydraulically or mechanically telescopic, hydraulically operated caterpillar substructure and a superstructure known per se, which is fully rotatable on a rotary mounting with a perpendicular axis, by the adjustability of the superstructure according to the invention relative to the substructure.

The provision of a wheeled substructure is also provided, which can be produced using standard commercial heavy duty axles and wherein the necessary all-round stability is achieved by the arrangement of support means according to the invention, including one or more wheel axles as support means.

Figure 16:
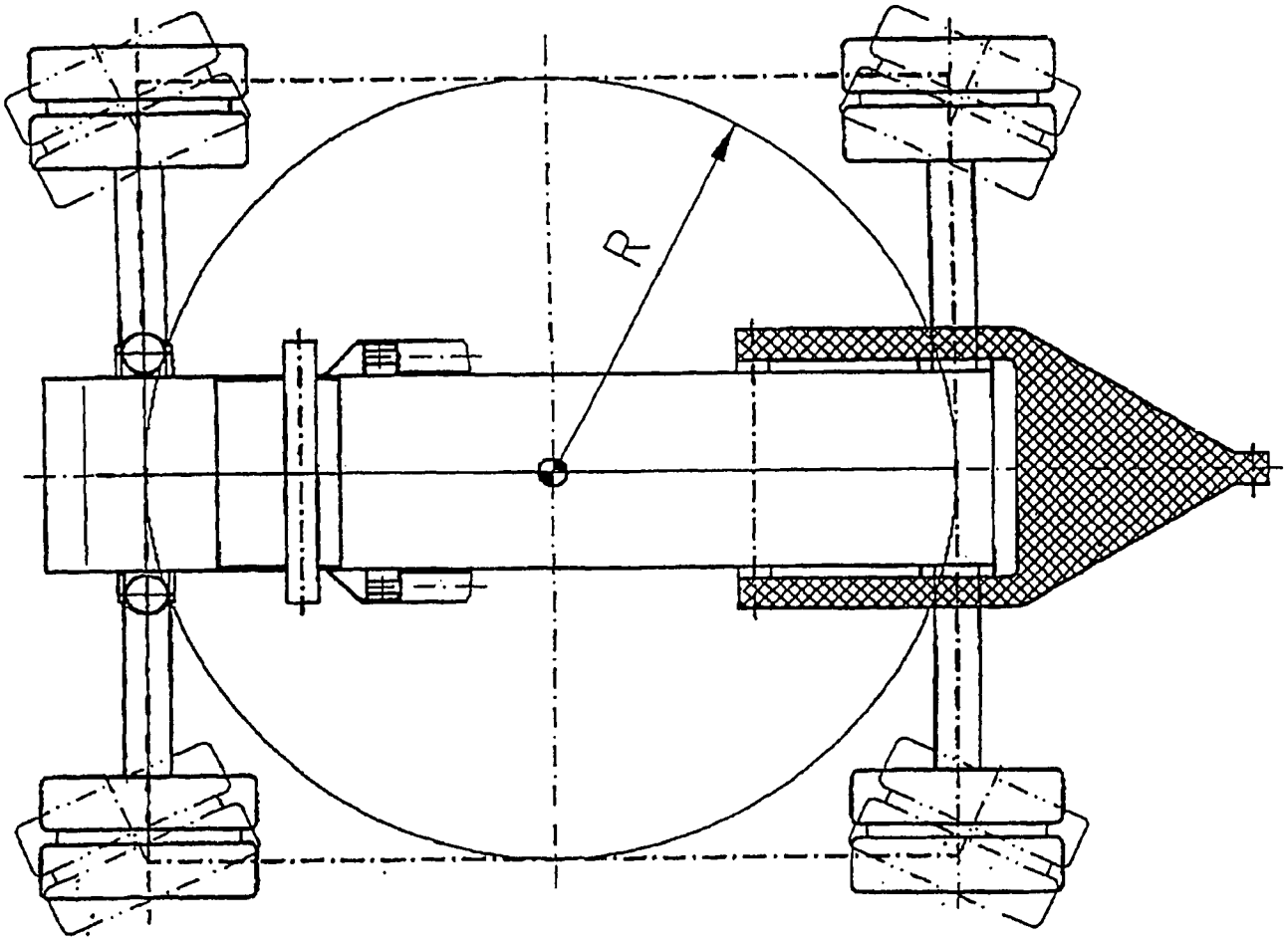
FIG. 16 shows a plan view of a substructure with two wheel axles, which has no additional support elements capable of being lowered.

If the width of the drive path is sufficient, the function of the support elements which are able to be lowered may of course be replaced by the wheel axles and the wheels, provided that the wheel axles are sufficiently far apart for the wheels to form a rectangle which is totally outside the tilting circle X. Assuming this, a wheel-driven goods transshipment apparatus can be produced without any additional support elements. Such an embodiment is shown in FIG. 16, looking down on the substructure.

What I claimed is:

1. A goods transshipment apparatus, comprising:

a) a mobile substructure having a front end and a rear end;

b) a superstructure rotatable relative to said mobile substructure about a vertical axis of rotation and includes a driver's cab and engine compartment;

c) a jib operably connected to said superstructure; and d) a pair of parallel connecting rods each of which is pivotally connected at a first end thereof to said mobile substructure and at a second end thereof to said superstructure to support said superstructure above said substructure in a higher operating position and to lower said superstructure relative to said substructure in a lower resting position wherein said axis of rotation remains vertical when said superstructure is raised or lowered to the upper operating position or the lower resting position, respectively, and wherein one of said pair of parallel connecting rods rests against said mobile substructure and the other of said parallel connecting rods rests on the ground behind said mobile substructure rear end when said superstructure is in the lower resting position.

2. A goods transshipment apparatus as in claim 1 and wherein said parallel connecting rods have substantially the same length.

3. A goods transshipment apparatus as in claim 1 and wherein said superstructure is provided with a subframe to which said parallel connecting rods are pivotally connected at opposite ends thereof, said subframe having a horizontally extending first section and a second section extending diagonally downward from said first section, one of said parallel connecting rods is pivotally connected to said first section and the other of said parallel connecting rods is pivotally connected to said second section.

4. A goods transshipment apparatus as in claim 1 and wherein said mobile substructure is provided with an endless track drive.

5. A goods transshipment apparatus as in claim 4 and wherein said endless track drive has an adjustable track width, said track width adjusted by telescopic guides.

6. A goods transshipment apparatus as in claim 1 and wherein said mobile substructure is provided with a wheeled drive having at least two wheel axles.

7. A goods transshipment apparatus as in claim 6 and further including:

a) at least one pair of support elements adapted to be selectively lowered into an extended ground engaging position from said transshipment apparatus so as to prevent tilting of said transshipment apparatus when said superstructure is in the upper operating position, the distance of at least one of said wheel axles from a rotational axis of said superstructure extending perpendicular thereto is greater than or equal to the distance between the rotational axis and said at least one pair of support elements when in the lowered ground engaging position.

8. A goods transshipment apparatus as in claim 7 and wherein said at least one pair of support elements are arranged between said at least two wheel axles.

9. A goods transshipment apparatus as in claim 8 and further including:

a) a second pair of support elements extending from said mobile substructure at one end thereof.

10. A goods transshipment apparatus as in claim 1 and wherein at least one of said pair of parallel connecting rods is a four point connecting rod.

11. A goods transshipment apparatus as in claim 1 and wherein at least one of said pair of parallel connecting rods is a three point connecting rod.

12. A goods transshipment apparatus as in claim 1 and wherein when said superstructure is in the upper operating position, said pair of parallel connecting rods are positioned at an angle of inclination between about 0 degree and about 20 degree to the vertical.

13. A goods transshipment apparatus as in claim 1 and wherein said apparatus is adapted to be driven when said superstructure is in a partly lowered intermediate position.

14. A goods transshipment apparatus as in claim 1 and wherein said jib includes a loading arm and a grab member operatively associated therewith.

15. A goods transshipment apparatus as in claim 1 wherein said mobile substructure is provided with a central undercarriage member to which said parallel connecting rods are pivotally connected.

16. A goods transshipment apparatus as in claim 1 and further including:

a) a control cylinder operatively associated with said pair of parallel connecting rods for moving the same.

17. A goods transshipment apparatus as in claim 1 and wherein said superstructure is moved relative to said substructure between the lower resting and upper operating positions in the manner of a parallel linkage or parallelogram upon movement of at least one of said pair of parallel connecting rods.

18. A goods transshipment apparatus as in claim 1 and wherein one of said parallel connecting rods has a bent configuration.

19. A goods transshipment apparatus, said apparatus comprising:

a) a mobile substructure having a front end and a rear end;

b) a superstructure rotatable relative to said mobile substructure and includes a driver's cab and engine compartment;

c) a jib operably connected to said superstructure; and d) a connecting rod arrangement for selectively moving said superstructure relative to said mobile substructure between a lower resting position and an upper operating position said connecting rod arrangement comprising a pair of connecting rods each of which is pivotally connected at a first end thereof to said mobile substructure and at a second end thereof to said superstructure, the pivotal connections at each of said pair of connecting rods defining a parallelogram and wherein one of said pair of connecting rods rest on said substructure and the other of said pair of connecting rods rests on the ground behind said substructure when said superstructure is in the lower resting position.

* * * * *